US012663022B2

(12) United States Patent
Sarjas et al.

(10) Patent No.: US 12,663,022 B2
(45) Date of Patent: Jun. 23, 2026

(54) ELECTRIC MOTOR PUMP

(71) Applicant: MAHLE International GmbH, Stuttgart (DE)

(72) Inventors: Andreas Sarjas, Turnisce (SI); Alen Cingerle, Nova Gorica (SI)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 18/954,355

(22) Filed: Nov. 20, 2024

(65) Prior Publication Data

US 2025/0163934 A1 May 22, 2025

(30) Foreign Application Priority Data

Nov. 20, 2023 (DE) ..... 10 2023 211 548.4

(51) Int. Cl.
*F04D 29/58* (2006.01)
*F04D 1/00* (2006.01)
*F04D 13/06* (2006.01)

(52) U.S. Cl.
CPC ..... *F04D 29/5806* (2013.01); *F04D 13/06* (2013.01); *F04D 1/00* (2013.01)

(58) Field of Classification Search
CPC .. F04D 13/06; F04D 13/0633; F04D 29/5806; F04D 29/588
See application file for complete search history.

(56) References Cited

U.S. PATENT DOCUMENTS 3,220,349 A * 11/1965 White ..... F04D 29/0416 417/357
4,013,384 A 3/1977 Oikawa
5,997,261 A 12/1999 Kershaw
2014/0265692 A1 9/2014 Schneider
2017/0268523 A1 9/2017 Zanotto Filho

FOREIGN PATENT DOCUMENTS

AT 502566 A1 4/2007
DE 2532262 A1 1/1976
DE 69804745 T2 11/2002
DE 102011117183 A1 8/2012
EP 3073119 A1 9/2016

OTHER PUBLICATIONS

German Search Report for DE10 2023 211 548.4.

* cited by examiner

*Primary Examiner* — Kenneth J Hansen
(74) *Attorney, Agent, or Firm* — Fishman Stewart PLLC

(57) ABSTRACT

An electric motor-driven pump is configured to convey fluid. The pump includes a pump housing which has a suction region and an outlet region and delimits or forms a pump chamber. A hollow rotor axle, through which a rotor channel passes, and a pump impeller, which is mounted on the same in a rotationally adjustable manner, are arranged in the pump chamber for conveying fluid. The electric motor-driven pump has a cooling circuit that is open to the pump chamber and is designed to cool an electric drive motor arranged in a motor region of the pump housing to drive the pump impeller in rotation.

20 Claims, 4 Drawing Sheets

ELECTRIC MOTOR PUMP

CROSS REFERENCE TO RELATED APPLICATION

This application claims priority to German Patent Application No. DE102023211548.4, filed on Nov. 20, 2023, the contents of which is hereby incorporated by reference in its entirety.

TECHNICAL FIELD

The invention relates to an electric motor-driven pump for pumping a fluid.

BACKGROUND

An electric motor-driven pump can be used to convey any fluids reliably and with predeterminable volume flows, so that they are frequently used in automotive engineering in particular, for example to convey coolant. The disadvantage of these pumps is that the components used in them, such as electric drive motors and electronic components, operate with losses and therefore heat up when used as intended. Pumps are therefore equipped with cooling devices that allow them to be temperature-controlled and operated within a specified operating temperature window.

Electric motor-driven pumps with a cooling device of this type are described, for example, in EP 3 073 119 A1 and US 2017/0268523 A1. The cooling devices are designed as open cooling circuits in which fluid, which is diverted from a pump delivery flow, is conveyed as a cooling flow through a cooling channel passing through the pump by means of a pressure difference between a suction region and an outlet region. After the cooling flow has passed through the cooling channel and absorbed heat from the components to be cooled, it is fed back into the delivery flow.

SUMMARY

As part of their development work, the inventors discovered that undesirable fluid mechanical effects occur when the cooling flow is fed back into the delivery flow. For example, turbulence forms in the inflow region of the cooling flow into the delivery flow, which acts as a flow barrier and increases the flow resistance of the pump. The flow resistance of the electric motor-driven pump depends on the volume flow of the delivery flow and the volume flow of the cooling flow, wherein the relationship is that the flow resistance in the inlet region increases with increasing volume flows. This results in large losses with the known electric motor-driven pumps, especially when pumping large volume flows. This means that the hydraulic efficiency of these electric motor-driven pumps is reduced.

The object of the invention is therefore to provide an improved or at least another embodiment of an electric motor-driven pump.

In the present invention, this task is solved in particular by the object of independent claim 1. Advantageous embodiments are the subject of the dependent claims and the description.

The basic idea of the invention is based on the consideration that the aforementioned undesirable fluid mechanical effects or the associated losses can be avoided or at least reduced by modifying the introduction of the coolant into the delivery flow, namely in such a way that the cooling flow fed back into the delivery flow and the delivery flow meet at a less unfavorable angle in terms of fluid mechanics.

For this purpose, the invention proposes the following electric motor-driven pump for pumping a fluid, in particular an electric motor-driven cooling pump for a vehicle. The proposed electric motor-driven pump has a pump housing which has a suction region and an outlet region and which delimits or forms a pump chamber into which the suction region and the outlet region open. A first path for a delivery flow of fluid is led through the suction region, the pump chamber and the outlet region, so that fluid can flow through the suction region, the pump chamber and the outlet region in this order. Furthermore, it is provided that a hollow rotor axle defining a center axis and axially penetrated by a rotor channel as well as a pump impeller, which is arranged on the hollow rotor axle and can be rotated about the center axis and driven by an electric motor, are arranged in the pump chamber for pumping fluid. The electric motor-driven pump also has a cooling circuit open to the pump chamber, i.e. fluidically connected to the pump chamber. The cooling circuit is formed by said rotor channel, a bypass channel that fluidically connects the pump chamber with the rotor channel, and a fluid distributor channel system that fluidically connects the rotor channel with the pump chamber. Furthermore, it is provided that a second path for a cooling flow of fluid leads through the cooling circuit, so that fluid can flow through the bypass channel, the rotor channel and the fluid distributor channel system, in particular in this order, for the purpose of cooling an electric drive motor arranged in a motor region of the pump housing for driving the pump impeller and/or control electronics arranged in the motor region. It is essential for the invention that the fluid distributor channel system is set up to introduce a cooling flow of fluid flowing through the cooling circuit during operation of the electric motor-driven pump, which is branched off from the delivery flow, into the pump chamber in an inflow direction which is different from an axial direction parallel to the center axis, i.e. an axial direction aligned parallel to the center axis.

As a result, the cooling flow returned to the pump chamber meets the delivery flow at a more favorable angle in terms of fluid mechanics than before, which can reduce the undesirable fluid mechanical effects mentioned above. This has the advantage that the flow resistance of the pump in particular is significantly reduced compared to known electric motor-driven pumps. The proposed electric motor-driven pump therefore has a comparatively high hydraulic efficiency and can be operated in an energy-efficient and cost-effective manner, particularly when pumping large volume flows.

It is expedient that the inflow direction is radial with respect to the center axis. For the purposes of the present invention, "radial" or "that the inflow direction runs radially with respect to the center axis" means that the inflow direction runs through the center axis and is angularly tilted with respect to the center axis and is merely not parallel to the center axis. It is also possible that the inflow direction runs vertically through the center axis. This provides an orientation for the inflow direction in which the inflow direction runs radially perpendicular through the center axis. Based on the specified orientations of the inflow direction, undesirable fluid mechanical effects can be further reduced, so that the flow resistance of the proposed electric motor-driven pump is further reduced in comparison with known electric motor-driven pumps.

The hollow rotor axle is fixed to the pump housing. However, the hollow rotor axle could be designed as a hollow rotor shaft. In particular, the pump impeller is fixed to the hollow rotor shaft and the hollow rotor shaft and the pump impeller are rotationally adjustable with respect to the center axis.

It would also be advantageous to redirect and align the inflow direction in the pump impeller or in the hollow rotor axle so that the cooling flow has a velocity component in the direction of the delivery flow.

In particular, the inflow direction can span an inflow angle between itself and a radial axis perpendicular to the center axis, which lies in the angle range between 0° and less than 90°. This specifies a preferred orientation range for the inflow direction of the cooling flow, wherein the orientation for the inflow direction is this time determined with respect to a radial direction perpendicular to the center axis. The said angle range can preferably be between 0° and 60° and more preferably between 0° and 45°. This allows the inflow angle of the cooling flow to be adapted to a flow direction of the delivery flow, thus achieving a further improvement in the hydraulic efficiency of the proposed pump.

It is also useful to ensure that the inflow direction is parallel or essentially parallel to said flow direction of the delivery flow. During operation of the electric motor-driven pump, the flow direction of the delivery flow is set in an inflow region of the pump chamber into which the cooling flow is introduced. In this inflow region, the flow direction of the delivery flow can be parallel to the center axis or form an acute angle with the center axis. This provides a further preferred orientation for the inflow direction. This has the advantage that when the cooling flow is introduced into the pump chamber, there is practically no change in the flow direction of the cooling flow and therefore no significant increase in the flow resistance in this region. As a result, the hydraulic efficiency of the proposed pump is optimized and improved in comparison with known electric motor-driven pumps.

The fluid conveyed by the electric motor-driven pump can be a coolant, such as water, oil or similar. The delivery flow and the cooling flow are formed by the same fluid in the open cooling circuit.

The electric drive motor in question can usefully be designed as a wet rotor. For this purpose, the pump chamber is fluidically connected to the motor region. Alternatively, the electric drive motor can be designed as a dry-running motor, wherein the motor region is conveniently fluidically separated from the pump chamber. The electric motor-driven pump can have electronic components, in particular electronic components of the control electronics, in particular for controlling the electric drive motor. The electronic components can be conveniently arranged in the motor region and can be cooled using the open cooling circuit. The motor region can form a motor chamber.

Furthermore, the bypass channel can extend through at least one stator slot of a stator of the electric drive motor. As a result, heat generated in the region of the stator during operation of the electric motor-driven pump can be absorbed particularly well by the fluid flowing through the bypass channel and transported away. It may also be provided that the bypass channel extends at least in sections through the pump housing. Furthermore, it may be provided that the bypass channel extends at least in sections through the motor region of the pump housing or is formed at least in sections by the motor region. The bypass channel can be realized completely or at least in sections as a single bore or by a group of connected individual bores. The bypass channel can also be designed as an annular channel, at least in sections. It is also conceivable that the bypass channel is formed, at least in sections, by a free flow region that is bounded between a wall of the motor region and the electric drive motor arranged in the motor region. Furthermore, the bypass channel can be formed between said stator of the electric drive motor and a rotor of the electric drive motor.

It is useful if the pump chamber is divided by the pump impeller into a high-pressure section and a low-pressure section, wherein the high-pressure section is arranged between an outflow side of the pump impeller and the outlet region in terms of flow and the low-pressure section is arranged between an inflow side of the pump impeller and the suction region in terms of flow. It is clear to the skilled person that a fluid pressure that can be measured in the pumped fluid within the high-pressure section is greater than a fluid pressure that can be measured in the pumped fluid within the low-pressure section. Conveniently, the fluid forming the cooling flow is branched off from the high-pressure section of the pump chamber and fed into the open cooling circuit in the bypass channel. Furthermore, the fluid distributor channel system can be set up to introduce the cooling flow into a low-pressure section of the pump chamber. This means that after flowing through the open cooling circuit, the cooling flow is returned to the low-pressure section of the pump chamber using the fluid distributor channel system. The fluid is conveniently discharged from the open cooling circuit via the fluid distributor channel system in the delivery flow upstream of a fluid inlet for the open cooling circuit. This ensures that a pressure difference is created between the fluid inlet point and the fluid suction point of the open cooling circuit, which conveys the fluid through the open cooling circuit.

Furthermore, it may alternatively or additionally be provided that the cooling flow, after flowing through the open cooling circuit by means of the fluid distributor channel system, is introduced into a compression section of the pump chamber, in which the pump impeller is arranged, which is arranged between the low-pressure section and the high-pressure section in terms of flow.

The pump impeller can preferably be designed as a radial pump impeller. In this case, the fluid is conveyed from a radially inner inlet region to a radially outer outlet region. However, the pump impeller is not necessarily limited to this design and can, for example, be formed by an axial pump impeller.

Conveniently, it is provided that the rotor channel opens out at an axial end face of the hollow rotor axle arranged in the pump chamber, forming an overflow opening, wherein a holding device for the hollow rotor axle is arranged in the pump chamber, which is opposite an inflow side of the pump impeller facing the suction region and has a receptacle in which the hollow rotor axle together with its overflow opening, in particular an axle section of the hollow rotor axle arranged in the pump chamber and having the overflow opening, is accommodated. The holding device can have at least one distributor channel that forms the fluid distributor channel system. This indicates a preferred embodiment of the electromotive pump in which the fluid distributor channel system is formed on the holding device. The at least one distributor channel can be set up in such a way that it directs the cooling flow from the rotor channel into the pump chamber in the inflow direction.

It is expedient for the at least one distributor channel of the holding device to pass through in the inflow direction, starting from an inner surface of the receptacle of the holding device up to a lateral surface of the holding device facing the pump chamber. As a result, the rotor channel is fluidically connected to the pump chamber via the at least one distributor channel. This allows the cooling flow to be discharged from the open cooling circuit by the cooling flow flowing through the bypass channel and the rotor channel, overflowing via the overflow opening of the rotor channel into the at least one distributor channel of the fluid distributor channel system and then being introduced through the at least one distributor channel into the pump chamber.

The holding device is preferably arranged so that it can rotate relative to the pump impeller and/or the hollow rotor axle. In particular, the holding device is fixed in a fixed position on the housing.

In addition to the aforementioned axial end face with overflow opening, the hollow rotor axle also has a counter-axial end face that faces away from the pump chamber and the axial end face of the hollow rotor axle, at which the rotor channel opens out to form an inflow opening. The inlet opening can be located in the motor region, for example. In particular, an axial section of the hollow rotor axle with the inlet opening can be arranged in the motor region. Furthermore, the bypass channel can be fluidically connected to the inlet opening of the rotor channel.

The fluid distributor channel system or the at least one distributor channel of the fluid distributor channel system can expediently be set up in such a way that the cooling flow is directed onto the pump impeller or in the direction of the pump impeller when it is introduced into the pump chamber.

It is expedient that the said holding device has a conical body arranged coaxially with respect to the center axis, the cone tip of which faces the suction region or the flow direction of the delivery flow and at the cone base of which the holding device receptacle opens out, forming an insertion opening for the hollow rotor axle. The support arms described below can be arranged on the conical body. The conical shell of the conical body conveniently forms the said lateral surface of the holding device.

Preferably, a half opening angle of the cone body is at most 35°, in particular at most 30°, in particular less than 30°, in particular at least 10°. This half opening angle has proven to be a good compromise between a favorable flow to the cone body and the surface of the holding device and a compact design. In addition, a conical design of the holding device favors an alignment of the inflow direction in such a way that the cooling flow has a velocity component, in particular its maximum velocity component, in the direction of the conveying flow. Generally, the inflow angle is greater than half the opening angle. In particular, the inflow angle is between 30° and 45°.

It can also be provided that at least one further distributor channel is provided, wherein the distributor channels are point-symmetrical with respect to the center axis and/or axis-symmetrical with respect to a radial axis perpendicular to the center axis. As a result, the fluid distributor channel system is formed by several distributor channels, wherein these pass through the holding device in such a way that the distributor channels are point-symmetrical with respect to the center axis and/or axially symmetrical with respect to the radial direction.

It may also be provided that the at least one distributor channel has a cross-sectional area or the distributor channels each have a cross-sectional area, wherein the cross-sectional area or the sum of these cross-sectional areas is smaller in area than a cross-sectional area of the overflow opening of the rotor channel. This ensures preferential cooling.

It is also expedient for the holding device to have support arms by means of which the holding device is fixed to a wall of the pump chamber. In particular, the holding device and the pump housing can be designed integrally, for example as a cast, injection-molded and/or compression-molded component. Conveniently, the support arms are each formed integrally with said conical body of the holding device and/or the wall of the pump chamber. Furthermore, the support arms can be designed to be point-symmetrical with respect to the center axis and/or arranged point-symmetrically on the conical body with respect to the center axis.

It is also practical for the support arms to have a flow-effective or non-flow-effective profile. This allows the delivery flow rate to be specifically influenced if required.

It is expedient that the hollow rotor axle has a plain bearing ring and the holding device has a counter plain bearing ring, wherein the hollow rotor axle is supported axially and/or radially with respect to the center axis on the counter plain bearing ring of the holding device via the plain bearing ring. This means that the hollow rotor axle is mounted on the holding device. It may be expedient to provide that the said receptacle of the holding device is stepped. The counter plain bearing ring of the holding device can be arranged in a first step of the holding device receptacle that is adjacent to said insertion opening of the holding device receptacle. Furthermore, the at least one distributor channel or the distributor channels of the fluid distributor channel system can open into the receptacle of the holding device at or in the region of a second step of the receptacle of the holding device, which is adjacent to the first step.

Generally preferred is the distributor channel of the holding device being completely located on a side of the counter plain earing ring pointing away from the plain bearing ring in the axial direction. The counter plain bearing ring can be arranged between the respective distributor channel and the plain bearing ring. This ensures that the plain bearing ring and counter plain bearing ring interact as intended. In particular, at least one area of the distributor channel is directly bounded by the counter plain bearing ring.

In particular, at least one distributor channel, in particular the distributor channels, is open on the outer surface of the holding device in the axial direction towards the pump impeller. This can maximize a component of the cooling flow velocity in the direction of the pumping flow. In addition or as an alternative, the distributor channel is bounded in sections in the axial direction and perpendicular to it, i.e. radially, by the counter plain bearing ring.

In an alternative embodiment of the invention, it is expediently provided that the fluid distributor channel system is formed on or through the hollow rotor axle. The fluid distributor channel system can be realized by at least one distributor channel that passes through the hollow rotor axle and is set up in such a way that it introduces the cooling flow from the rotor channel into the pump chamber in the inflow direction.

In a further alternative embodiment of the invention, it is expediently provided that the fluid distributor channel system is formed on or through the pump impeller. The fluid distributor channel system can be conveniently formed by channels or chambers within the rotor channel and/or the pump impeller. This indicates a further preferred embodiment of the electric motor-driven pump, by means of which the cooling flow from the rotor channel can be introduced into the pump chamber in the inflow direction.

To summarize, it remains to be said: the present invention preferably relates to an electric motor-driven pump for conveying a fluid, having a pump housing which has a suction region and an outlet region and delimits or forms a pump chamber, wherein a hollow rotor axle, through which a rotor channel passes, and a pump impeller, which is rotatably adjustably mounted thereon, are arranged in the pump chamber for conveying fluid. The electric motor-driven pump has a cooling circuit open to the pump chamber, which is set up to cool an electric drive motor arranged in a motor region of the pump housing to drive the pump impeller and/or control electronics. An essential feature of the invention is that the electric motor-driven pump has a fluid distributor channel system which is arranged to introduce a cooling flow of fluid flowing through the open cooling circuit during operation of the electric motor-driven pump into the pump chamber in an inflow direction which is different from an axial direction which is parallel with respect to a center axis of the hollow rotor axle.

Further important features and advantages of the invention are apparent from the sub-claims, from the drawings, and from the associated description of the figures with reference to the drawings.

It is understood that the above-mentioned features and those yet to be explained below can be used not only in the combination indicated in each case, but also in other combinations or on their own, without deviating from the scope of the present invention.

Preferred embodiments of the invention are shown in the drawings and are explained in more detail in the following description, wherein identical reference signs refer to identical or similar or functionally identical components.

BRIEF DESCRIPTION OF THE DRAWING

They show, schematically in each case.

DETAILED DESCRIPTION

FIGS. 1 through 6 show a preferred embodiment of an electric motor-driven pump according to the invention, designated as a whole by the reference number 1, by means of which any fluid such as water and the like can be reliably conveyed at pre-settable volumetric flows. For example, it may be an electric motor-driven cooling pump for a vehicle that can be used in automotive engineering, wherein the field of application of the proposed electric motor-driven pump 1 is not limited to this.

Figure 1:
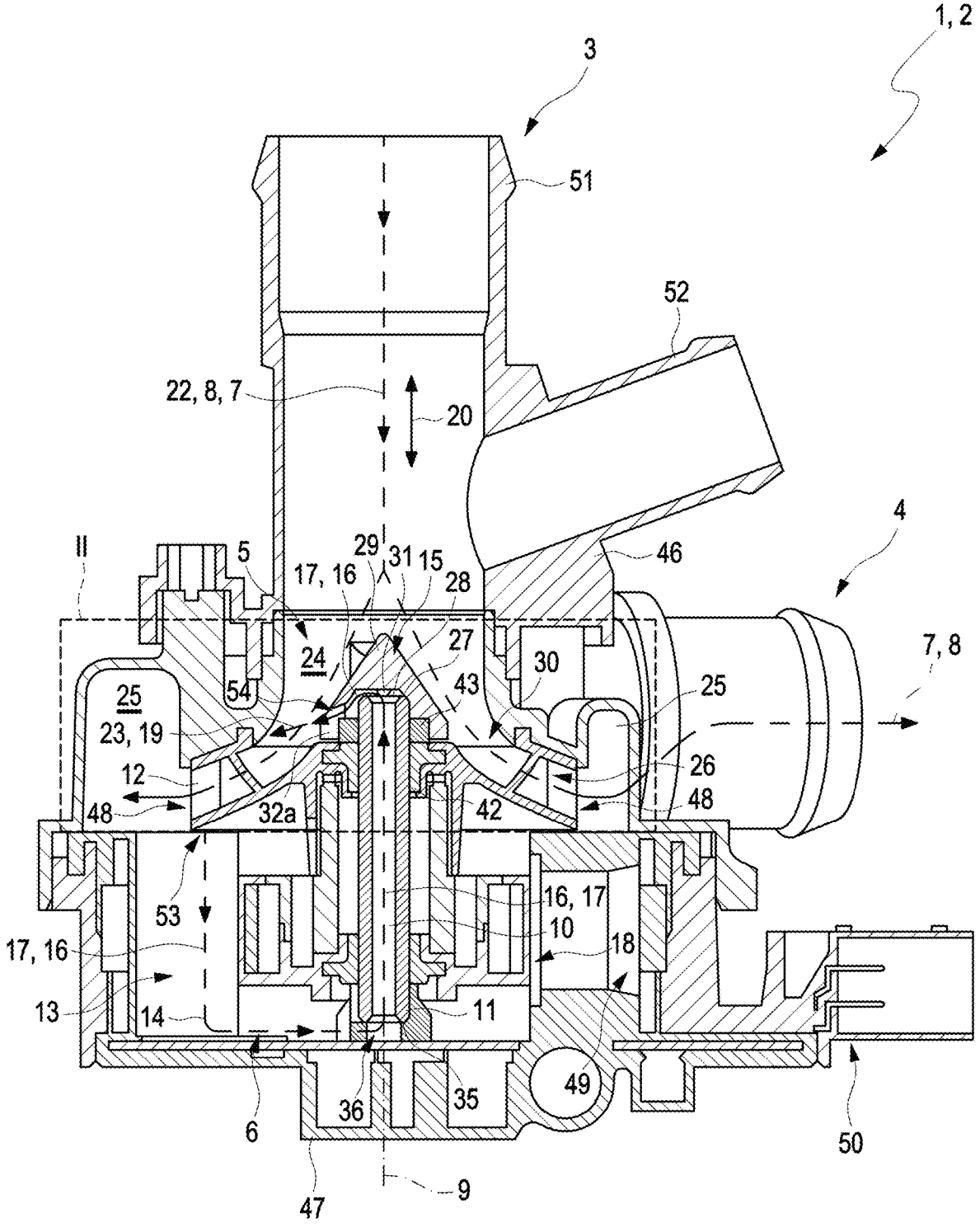
FIG. 1 a longitudinal sectional view of a preferred embodiment of an electric motor-driven pump according to the invention, FIG. 2 a section of FIG. 1 according to a box marked with a dashed line, FIG. 3 the electric motor-driven pump from FIG. 1, but in a different longitudinal sectional view, wherein the section is made through a support arm of the holding device, FIG. 4 a perspective view of the holding device of the electric motor-driven pump from FIG. 1, FIGS. 5 and 6 each show the holding device of the electric motor-driven pump from FIG. 1 in a perspective view from diagonally behind, wherein the hollow rotor axle and the rotor in particular are omitted in favor of a better view of the holding device.
Figure 2:
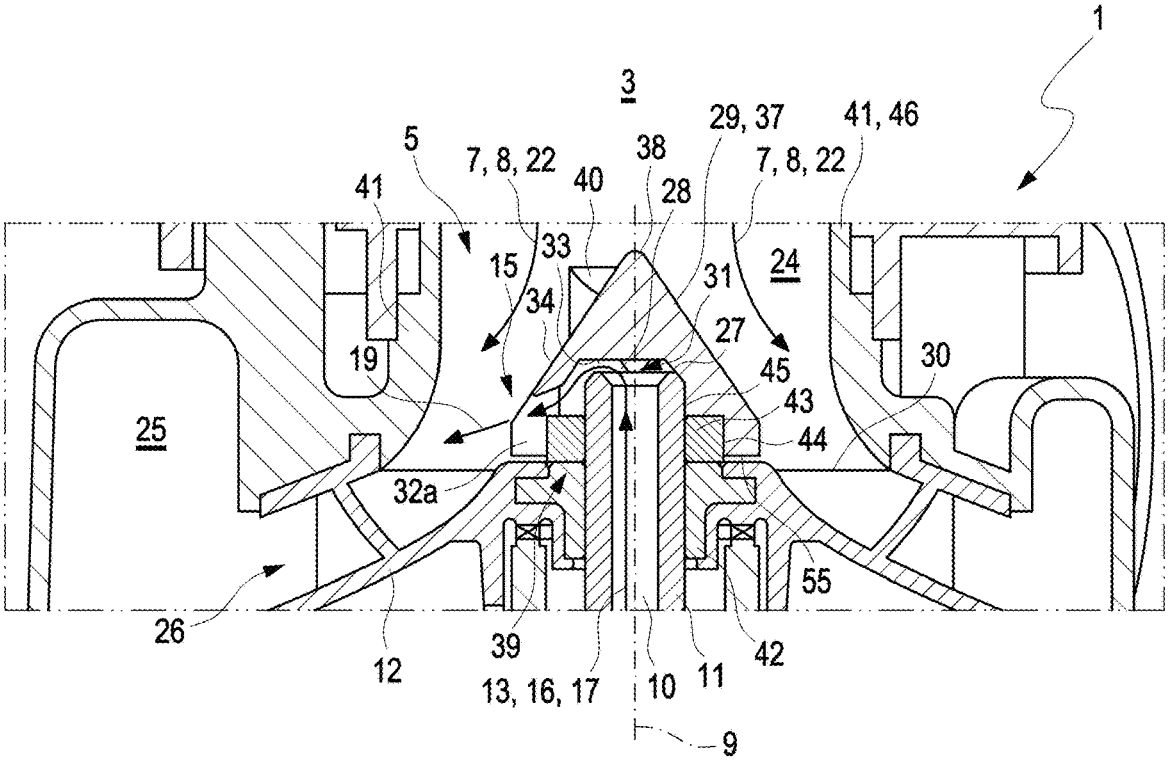
Figure 3:
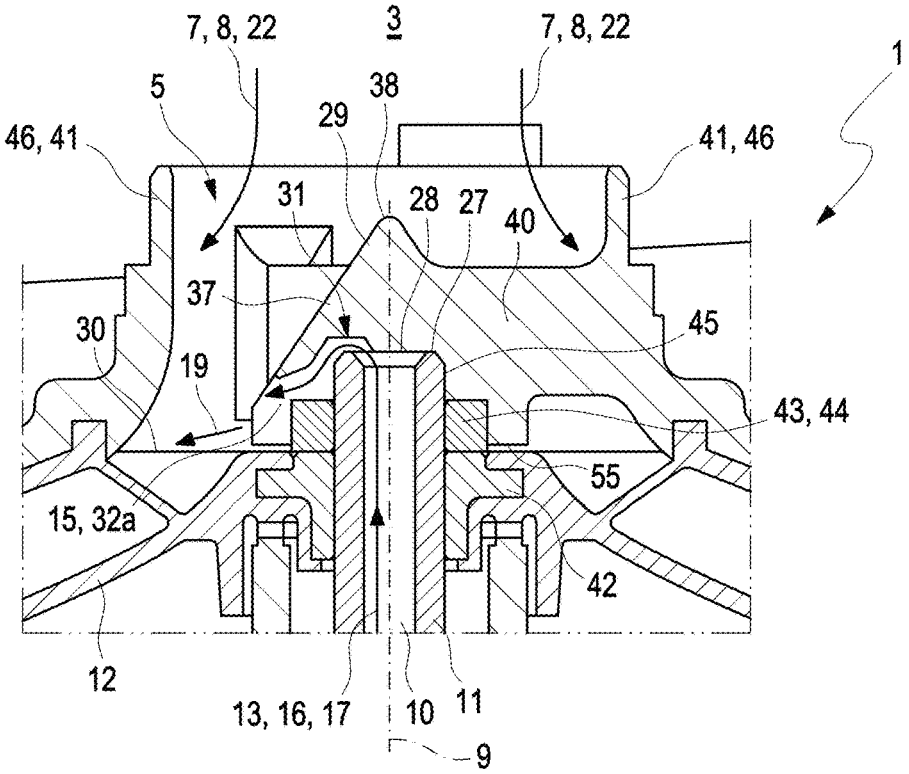
Figure 4:
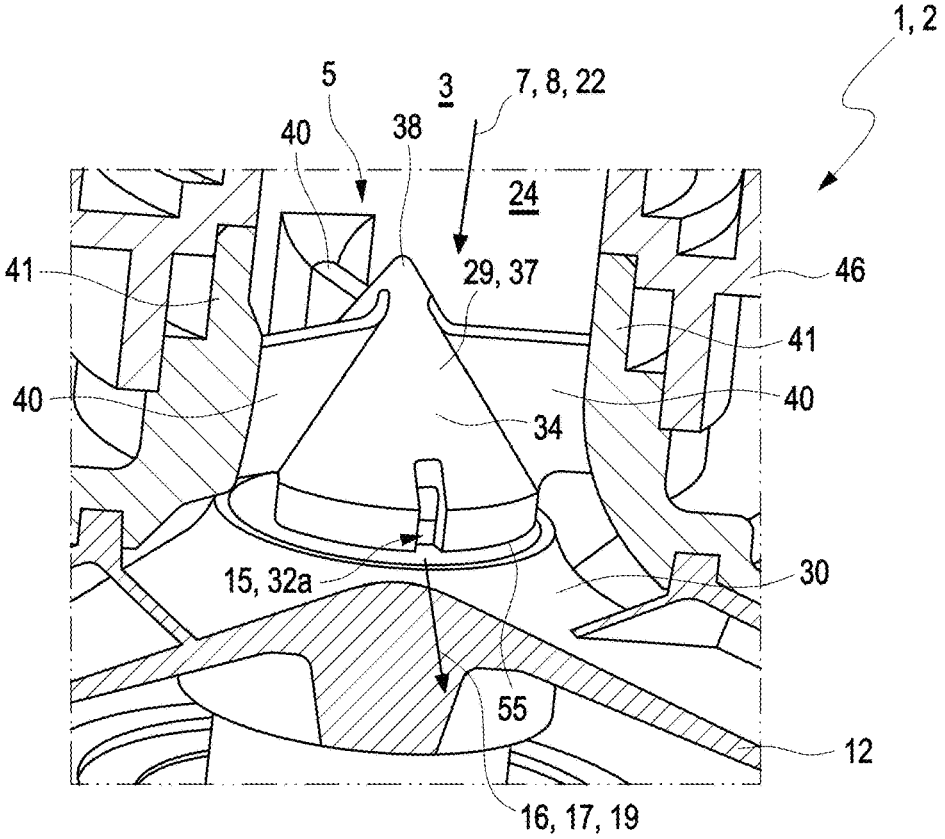

The electric motor-driven pump 1 according to FIG. 1 has, purely by way of example, a multi-part pump housing 2 which has at least one suction region 3 with two separate inlets 51,52, one outlet region 4, one upper housing part 46 and one lower housing part 47 arranged on the upper housing part 46. The upper housing part 46 of the pump housing 2 forms or delimits a pump chamber 5 into which the suction region 3 and the outlet region 4 open. A first path 7, indicated by a dashed line, for a delivery flow 8 of fluid passes through the suction region 3, the pump chamber 5 and the outlet region 4, wherein the fluid can flow through the suction region 3, the pump chamber 5 and the outlet region 4 in this order. FIG. 1 also shows that an axle section of a hollow rotor axle 11, through which a rotor channel 10 passes axially, and a pump impeller 12, which can be rotated about the center axis 9 on the hollow rotor axle 11 and driven by an electric motor, are arranged in the pump chamber 5 for pumping fluid. The pump impeller 12 is designed as a radial pump impeller and subdivides the pump chamber 5 into a high-pressure section 25 and a low-pressure section 24, wherein the high-pressure section 25 is arranged between an outflow side 48 of the pump impeller 12 and the outlet region 4 and the low-pressure section 24 is arranged between an inflow side 30 of the pump impeller 12 and the suction region 3. A compression section 26, in which the pump impeller is located, is arranged fluid mechanically between the low-pressure section 24 and the high-pressure section 14. The hollow rotor axle 12 has an axial end face 27 at the said axle section located in the pump chamber 5, at which the rotor channel 10 opens to form an overflow opening 28.

The lower housing part 47 of the pump housing 2 limits or forms a motor region 6, which is arranged on the pump chamber 5 and in which an electric drive motor 18 is arranged to drive the pump impeller 12 in a rotary manner. In the motor region, 6 electronic components for controlling the electric drive motor 18 are placed here in their entirety, labeled 49. The hollow rotor axle 11 has, on its wider axle section, a counter-axial end face 35 which faces away from the pump chamber 5 and the axial end face 27 of the hollow rotor axle 11 and is arranged in the motor region 6, and into which the rotor channel 10 opens, forming an inflow opening 36. Furthermore, it can be seen that a supply connection 50 is arranged on the lower housing part 47, by means of which the electric drive motor 18 and the electronic components 49 can be supplied with electrical energy and information can be exchanged, for example, with an external control unit not illustrated here. The upper housing part 46 and the lower housing part 47 are, for example, fixed to one another in a fluid-tight and detachable manner by means of fastening screws and sealing means such as sealing cords or the like.

During intended use of the electric motor-driven pump 1, the electric drive motor 18 and the electronic components 49 heat up. The electric motor-driven pump 1 is therefore equipped with a cooling circuit 13 that is open to the pump chamber 5 and to the delivery flow 8, by means of which the electric drive motor 18 and/or the electronic components 49 can be cooled and kept within a predetermined operating temperature window.

The open cooling circuit 13 is formed by the rotor channel 10, a bypass channel 14, which fluidically connects the pump chamber 5 to the rotor channel 10, and a fluid distributor channel system 15, which fluidically connects the rotor channel 10 to the pump chamber 5. In the present case, the bypass channel 14 extends at least in sections through the lower housing part 47 of the pump housing 2 and/or at least in sections through the motor region 6. A second path 16 for a cooling flow 17 of fluid extends through the open cooling circuit 13. When the electric motor-driven pump 1 is in operation, fluid that is diverted from the pump chamber 5 at an inlet 53 of the open cooling circuit 13 can initially flow into the bypass channel 14 as a cooling flow 17. The cooling flow 17 then passes completely through the bypass channel 14 and enters the rotor channel 10 through the inlet opening 36. The cooling flow 17 passes completely through the rotor channel 10 and enters the fluid distributor channel system 15 via the overflow opening 28, so that the cooling flow 17 is then returned to the pump chamber 5 via the fluid distributor channel system 15 at an outlet 54 of the open cooling circuit 13. The cooling flow 17 absorbs heat from the components of the electric motor-driven pump 1 to be cooled along the second path 16, which is then directed into the pump chamber 5 with the cooling flow 17 and discharged from the electric motor-driven pump 1 with the delivery flow 8. The open cooling circuit 13 is designed in such a way that the fluid is conveyed through the rotor channel 10, the bypass channel 14 and the fluid distributor channel system 15 by means of a pressure difference that occurs between the inlet 53 and the outlet 54. For this purpose, the outlet 54 is arranged in the delivery flow 8 upstream of the inlet 53, for example in the low-pressure section 24 or in the compression section 25 of the pump chamber 5.

In the present case, the said fluid distributor channel system 15 is designed to introduce the cooling flow 17 flowing through the open cooling circuit 13 during operation of the electric motor-driven pump 1 into the pump chamber 5 with a predetermined inflow direction 19. The inflow direction 19 is different from a center axis parallel axial direction 20, i.e. an axial direction 20 parallel to the center axis 9. The direction of inflow 19 is preferably radial with respect to the center axis 9 and can in particular be perpendicular to the center axis 9. Preferably, the inflow direction 19 is parallel or essentially parallel to the flow direction 22 of the delivery flow 8, which occurs during operation of the electric motor-driven pump 1 in an inflow region 23 of the pump chamber 5, into which the cooling flow 17 is introduced. On the basis of the orientation of the inflow direction 19, the cooling flow 17 is introduced into the pump chamber 5 in such a way that it hits the delivery flow 8 at a more favorable angle in terms of fluid mechanics than before. This reduces undesirable fluidic effects such as turbulence or the like, so that the flow resistance of the electric motor-driven pump 1 is reduced and a comparatively high hydraulic efficiency is achieved.

Figure 5:
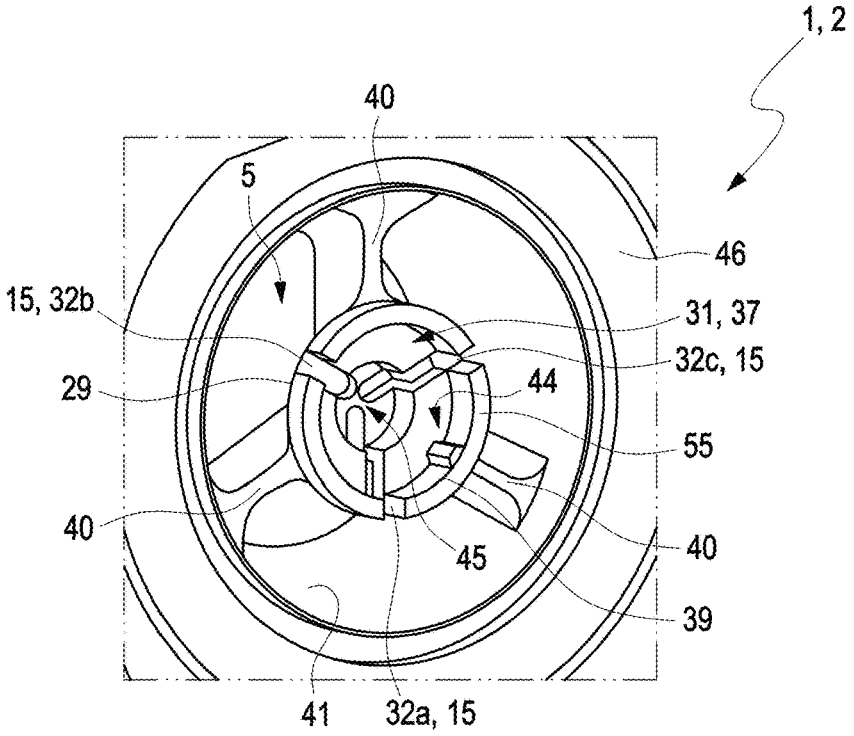
Figure 6:
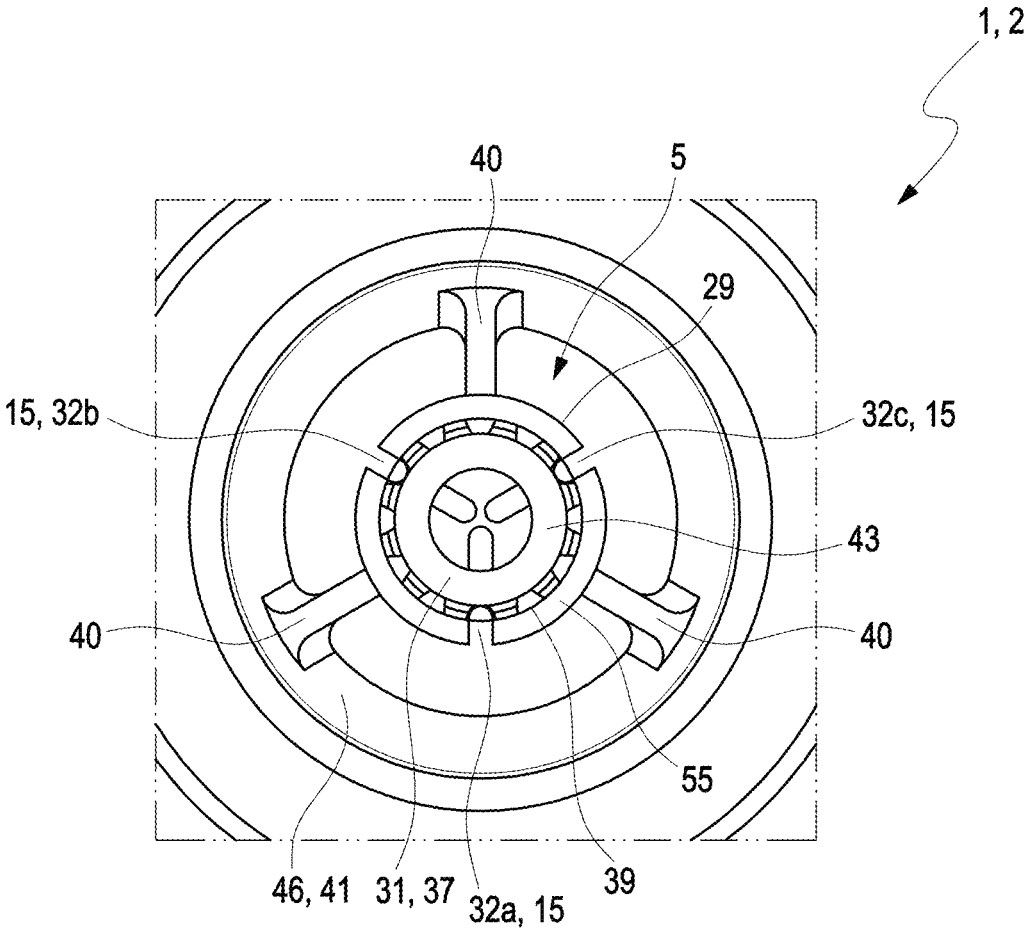

FIGS. 1-6 show that a holding device 29 for the hollow rotor axle 11 is arranged in the low-pressure section 24 of the pump chamber 5, which is located opposite the inflow side 30 of the pump impeller 12 facing the suction region 3 facing the inflow side 30 of the pump impeller 12 and has a receptacle 31, in which the hollow rotor axle 11 is received together with its overflow opening 28. The holding device 29 has a conical body 37 that is arranged coaxially with the center axis 9, or is formed by it. The conical body has a cone tip 38, which faces the suction region 3, and a cone floor 55, at which the receptacle 31 of the holding device 29 opens, forming an insertion opening 39 for the hollow rotor axle 11. Furthermore, it can be seen in FIGS. 1-6 that the holding device 29 is fixed to a wall 41 of the upper housing part 46 by means of three integral support arms 40. The said receptacle 31 is designed in a stepped manner in the present case and has a first step 44 which rests against the said insertion opening 39 of the receptacle 31 and in which a counter plain bearing ring 43 is received and fixed. The pump impeller 12 has a plain bearing ring 42, wherein the pump impeller 12 is supported axially and/or radially with respect to the center axis 9 on the counter plain bearing ring 43 of the holding device 29 and/or on the hollow rotor shaft 11 via the plain bearing ring 42. The holding device 29 has several distributor channels 32*a*, 32*b*, 32*c*, which together form the said fluid distributor channel system 15. The distributor channels 32*a*, 32*b*, 32*c* pass through the holding device 29 and the conical body 37 of the holding device 29 in the inflow direction 19, starting from the first step 44 of an inner surface 33 of the receptacle 31 of the holding device 29, up to a lateral surface 34 of the holding device 29 facing the pump chamber 5, whereby they can introduce the cooling flow 17 from the rotor channel 10 into the pump chamber 5 in the inflow direction 19. In FIGS. 5 and 6, it can be seen that the distributor channels 32*a*, 32*b*, 32*c* are axially point-symmetrical with respect to the center axis 9 and/or axially symmetrical with respect to a radial direction perpendicular to the center axis 9. The holding device 29 is designed so that the distributor channels 32*a*, 32*b*, 32*c* are open on the lateral surface 34 in the axial direction towards the pump impeller 12. This maximizes the velocity component of the cooling flow in the direction of the flow during operation.

The invention claimed is:

1. An electric motor-driven pump comprising:

a pump housing that has a suction region and an outlet region and also delimits or forms a pump chamber into which the suction region and the outlet region open, wherein a first path for a delivery flow leads through the suction region, the pump chamber and the outlet region, so that fluid can flow through the suction region, the pump chamber and the outlet region, wherein a hollow rotor axle defining a center axis and axially penetrated by a rotor channel is arranged in the pump chamber, as well as a pump impeller mounted on the hollow rotor axle, adjustable in rotation about the center axis and drivable by an electric drive motor, for pumping fluid, wherein the electric motor-driven pump has a cooling circuit which is open to the pump chamber and which is formed by the rotor channel, a bypass channel which fluidically connects the pump chamber with the rotor channel, and a fluid distributor channel system, which fluidically connects the rotor channel with the pump chamber, wherein a second path for a cooling flow of fluid leads through the open cooling circuit, so that the bypass channel and the rotor channel serve to cool the electric drive motor arranged in a motor region of the pump housing for driving the pump impeller in rotation, and the fluid distributor channel system can be flowed through by fluid, wherein the fluid distributor channel system is set up to introduce the cooling flow of fluid flowing through the open cooling circuit during operation of the electric motor-driven pump, which is branched off from the delivery flow, into the pump chamber in an inflow direction which is different from an axial direction parallel to the center axis;

wherein the rotor channel opens out at an axial end face of the hollow rotor axle, which axial end face is arranged in the pump chamber, forming an overflow opening;

wherein a holding device for the hollow rotor axle is arranged in the pump chamber, which holding device lies opposite an inflow side of the pump impeller facing the suction region and has a receptacle in which the hollow rotor axle is received together with the overflow opening;

wherein the holding device has at least one distributor channel that forms the fluid distributor channel system;

wherein the pump impeller has a plain bearing ring and the holding device has a counter plain bearing ring; and wherein the pump impeller is supported by the counter plain bearing ring of the holding device and/or the hollow rotor axle via the plain bearing ring axially and/or radially with respect to the center axis.

2. The electric motor-driven pump according to claim 1, wherein the inflow direction is radial with respect to the center axis.

3. The electric motor-driven pump according to claim 1, wherein the inflow direction is perpendicular to a flow direction of the cooling flow within the rotor channel.

4. The electric motor-driven pump according to claim 2, wherein the inflow direction is perpendicular to a flow direction of the cooling flow within the rotor channel.

5. The electric motor-driven pump according to claim 1, wherein the inflow direction is aligned parallel or essentially parallel with respect to a flow direction of the delivery flow.

6. The electric motor-driven pump according to claim 1, wherein the fluid distributor channel system is designed to introduce the cooling flow into a low-pressure section of the pump chamber, which is arranged axially between the inflow side of the pump impeller and the suction region.

7. The electric motor-driven pump according to claim 1, wherein the at least one distributor channel passes through the holding device in the inflow direction starting from an inner surface of the receptacle of the holding device up to a lateral surface of the holding device facing the pump chamber.

8. The electric motor-driven pump according to claim 1, wherein:

at least one additional distributor channel is provided, and the distributor channels are rotationally-symmetrical with respect to the center axis.

9. The electric motor-driven pump according to claim 7, wherein:

at least one additional distributor channel is provided, and the distributor channels are rotationally-symmetrical with respect to the center axis.

10. The electric motor-driven pump according to claim 1, wherein the holding device has support arms securing the holding device to a wall of the pump chamber.

11. The electric motor-driven pump according to claim 7, wherein the holding device has support arms securing the holding device to a wall of the pump chamber.

12. The electric motor-driven pump according to claim 8, wherein the holding device has support arms securing the holding device to a wall of the pump chamber.

13. The electric motor-driven pump according to claim 1, wherein the at least one distributor channel of the holding device is arranged completely on a side of the counter plain bearing ring pointing away from the plain bearing ring with respect to the axial direction.

14. The electric motor-driven pump according to claim 1, wherein the holding device has a conical body arranged coaxially with respect to the center axis, the conical body having a cone tip facing the suction region and a cone base defining the receptacle of the holding device that provides an insertion opening for the hollow rotor axle.

15. An electric motor-driven pump comprising:

a pump housing defining a suction region, an outlet region, and a pump chamber in fluid communication with the suction region and the outlet region, wherein a delivery flow path extends through the suction region, the pump chamber, and the outlet region;

an electric motor arranged in a motor region of the pump housing;

a hollow rotor axle arranged in the pump chamber, the hollow rotor axle defining a center axis and having a rotor channel extending axially therethrough;

a pump impeller rotatably mounted on the hollow rotor axle and driven by the electric motor to pump fluid along the delivery flow path;

a holding device for the hollow rotor axle arranged in the pump chamber opposite an inflow side of the pump impeller; and an open cooling circuit comprising the rotor channel, a bypass channel connecting the pump chamber to the rotor channel, and a fluid distributor channel system connecting the rotor channel to the pump chamber, wherein a cooling flow path extends through the open cooling circuit for a cooling fluid branched from the delivery flow path to cool the electric motor, wherein the fluid distributor channel system is configured to introduce the cooling fluid from the cooling circuit into the pump chamber in an inflow direction that is different from an axial direction parallel to the center axis, and wherein the pump impeller comprises a plain bearing ring and the holding device comprises a counter plain bearing ring, the pump impeller being supported axially or radially relative to the center axis by at least one of the counter plain bearing ring and the hollow rotor axle via the plain bearing ring.

16. The electric motor-driven pump according to claim 15, wherein the fluid distributor channel system comprises at least one distributor channel extending through the holding device in the inflow direction from an inner surface of a receptacle of the holding device to a lateral surface of the holding device facing the pump chamber.

17. The electric motor-driven pump according to claim 15, wherein the holding device comprises support arms securing the holding device to a wall of the pump chamber.

18. The electric motor-driven pump according to claim 15, wherein the fluid distributor channel system comprises at least one distributor channel arranged entirely on a side of the counter plain bearing ring.

19. The electric motor-driven pump according to claim 18, wherein the holding device comprises a conical body arranged coaxially with respect to the center axis, the conical body having a cone tip facing the suction region and a cone base defining a receptacle of the holding device that provides an insertion opening for the hollow rotor axle.

20. The electric motor-driven pump according to claim 15, wherein the fluid distributor channel system comprises a plurality of distributor channels arranged in rotational-symmetry with respect to the center axis.

* * * * *